US009618201B2

(12) United States Patent
Bettinzoli

(10) Patent No.: US 9,618,201 B2
(45) Date of Patent: Apr. 11, 2017

(54) GAS BURNER WITH MEANS FOR PREVENTING FLAME PROPAGATION

(75) Inventor: Angelo Bettinzoli, Concesio (IT)

(73) Assignee: SABAF S.P.A., Ospitaletto (BS) (IT)

( * ) Notice: Subject to any disclaimer, the term of this patent is extended or adjusted under 35 U.S.C. 154(b) by 382 days.

(21) Appl. No.: 13/806,709

(22) PCT Filed: Jun. 30, 2010

(86) PCT No.: PCT/IT2010/000291

§ 371 (c)(1),
(2), (4) Date: Mar. 5, 2013

(87) PCT Pub. No.: WO2012/001715

PCT Pub. Date: Jan. 5, 2012

(65) Prior Publication Data

US 2013/0164699 A1 Jun. 27, 2013

(51) Int. Cl.
*F23D 14/82* (2006.01)
*F23D 14/04* (2006.01)

(52) U.S. Cl.
CPC ..... *F23D 14/82* (2013.01); *F23D 14/04* (2013.01); *F23D 2900/14062* (2013.01)

(58) Field of Classification Search
CPC ..... F24C 3/085; F23D 14/82; F23D 14/04
USPC ..... 431/354; 126/39 E
See application file for complete search history.

(56) References Cited

U.S. PATENT DOCUMENTS 1,503,042 A * 7/1924 Gosmann ..... F23D 14/64 431/122
4,702,692 A * 10/1987 Burns et al. ..... 431/346
2007/0059657 A1* 3/2007 Yen ..... F23D 14/065 431/354

FOREIGN PATENT DOCUMENTS

| | | | |
|---|---|---|---|
| BE | 369095 A | | 4/1930 |
| BE | 369095 A1 | * | 4/1930 |
| FR | 1375471 | * | 11/1963 |
| GB | 12823 A | | 0/1911 |
| GB | 21078 A | | 0/1910 |
| GB | 21078 A1 | * | 0/1910 |
| GB | 1100278 A | | 1/1968 |

* cited by examiner

*Primary Examiner* — Avinash Savani
*Assistant Examiner* — Rabeeul Zuberi
(74) *Attorney, Agent, or Firm* — Lucas & Mercanti, LLP

(57) ABSTRACT

Gas burner for domestic use, of the type comprising at least one Venturi effect mixer in fluid connection with at least one combustion mixture distribution chamber and with at least one flame spreader associated with said distribution chamber, in addition to first means for preventing flame propagation of the fluid flow splitting type. Advantageously, the above-mentioned first preventing means is arranged downstream of the Venturi effect mixer and upstream of the combustion mixture distribution chamber, separating said Venturi effect mixer from the distribution chamber.

16 Claims, 4 Drawing Sheets

GAS BURNER WITH MEANS FOR PREVENTING FLAME PROPAGATION

CROSS-REFERENCE TO RELATED APPLICATION

This application is a 371 of PCT/IT2010/000291, filed Jun. 30, 2010, the contents of which are incorporated herein by reference.

FIELD OF THE INVENTION

The present invention concerns a gas burner for domestic use comprising at least one Venturi effect mixer in fluid connection with at least one chamber for distribution of the combustion mixture and at least one flame spreader associated with said distribution chamber, in addition to means for preventing propagation of the flame inside the burner, of the fluid flow splitting type.

BACKGROUND OF THE INVENTION

Gas burners for domestic use, in particular if designed to deliver a high thermal power, can suffer from the phenomenon of backfire, i.e. the fact that when the burner is turned off, therefore interrupting the flow of combustion gas into the Venturi effect mixer, the flame present outside the flame spreader can enter the burner and spread to the gas-primary air combustion mixture which is still present, stationary, inside the burner during the moments immediately after turn-off.

In particular, in the case of immediate re-ignition after the burner has been turned off, even 3-4 seconds after turn-off, the phenomenon of backfire, due in this case to the presence of unburned mixture inside the burner, ignited by the new flame lit by the user, is particularly frequent.

This phenomenon, which occurs in particular with the use of mains gas ("town gas", G110-8 mbar) as combustible gas, can be extremely harmful for some of the burner internal components, such as the Venturi effect mixer and, above all, the combustion gas injector, which is usually made of a material not able to effectively withstand the temperatures of the flame.

To prevent this phenomenon, in the known art a flat wire net is provided, having a fine mesh (for example 1 $mm^2$), which is positioned immediately downstream of the flame spreader and has the function of splitting the fluid flow into various fluid streams, imposing a local acceleration of said fluid flow when it crosses the above-mentioned wire net meshes, which is sufficient to stop the flame from spreading beyond said wire net.

For example, GB-A-1100278, in the name of Societe Anonyme La Couvinoise, teaches how to position, in a gas burner, a flat wire net inside the combustion mixture distribution chamber, immediately upstream of the relative flame spreader. Said wire net, obviously having a fine mesh, is able to arrest any propagation of the flame inside the above-mentioned burner distribution chamber and therefore inside the Venturi effect mixer, through to the relative injector.

While being effective in countering the phenomenon of backfire during turn-off of the burner, this solution nevertheless has some drawbacks, including the fact that it is necessary to provide a wire net with shape and dimensions such as to adapt perfectly to the geometry of the above-mentioned burner chamber, and the fact that said wire net, positioned near the holes of the flame spreader inside the mixture distribution chamber, can constitute an obstacle to correct distribution of the combustion mixture to the relative flame spreader, with consequent possible anomalies in distribution of the burner flames.

Furthermore, in the case of use of the burner described by GB-A-1100278 as a domestic burner for cooking food, arrangement of the wire net near the holes of the flame spreader entails on the one hand the risk of the user forgetting to refit the wire net after cleaning the burner, even superficially, and, on the other, the risk of remains of food getting into said wire net, with probable obstruction of at least part of the mesh and consequent malfunctioning of the burner.

The object of the present invention is therefore to provide a domestic gas burner comprising at least one Venturi effect mixer in fluid connection with at least one combustion mixture distribution chamber and with a relative flame spreader, which is provided with means for preventing propagation of the flame by splitting the fluid flow, without the drawbacks of those used in the known prior art.

A further object of the present invention is to provide a gas burner that effectively stops any backfire from penetrating into the burner structure, while being simple and inexpensive to produce.

A further object of the present invention is to produce a gas burner which comprises means for preventing propagation of the flame within said burner which are simple to produce, do not cause malfunctioning of the burner and at the same time are easy to assemble and disassemble inside the burner, while preventing accidental incorrect assembly.

A further object of the present invention is to produce a gas burner with means for preventing propagation of the backfire (i.e. back flames) able to prevent propagation of the backfire generated both during turn-off of the burner and during the turn-on transient.

BRIEF SUMMARY OF THE INVENTION

These and further objects are achieved by the gas burner according to the first independent claim and the subsequent dependent claims. The gas burner for domestic use, according to the present invention, comprises at least one Venturi effect mixer, which is in fluid connection with at least one combustion mixture distribution chamber and at least one relative flame spreader, associated with said distribution chamber, and first means for preventing flame propagation, of the fluid flow splitting type. Advantageously, these preventing means are positioned downstream of the Venturi effect mixer and substantially upstream of the above-mentioned combustion mixture distribution chamber, separating the Venturi effect mixer from said distribution chamber, i.e. forcing the combustion mixture coming out of the mixer, or during its possible return back, to pass through said preventing means.

It should be noted that, here and below, the term "distribution chamber" is used to indicate any chamber, duct or passage which, inside the burner, connects the Venturi effect mixer outflow section, in which complete mixing of the combustion gas with the primary air substantially takes place, and a relative flame spreader, in which the combustion gas—primary air mixture is emitted towards the outside. As will be clear to a person skilled in the art, the combustion mixture passes through and may also accumulate to a limited extent in said distribution chamber during its flow towards the holes or slits of the flame spreader.

Backfire preventing means interposed between the Venturi effect mixer outflow section and the above-mentioned combustion mixture distribution chamber are easy to produce, given the simple and reduced geometric conformation of the mixer outflow section, effective in preventing propagation of any backfire into the mixer and towards the injector, and without side effects on the burner external flames, given the distance of said preventing means from the flame spreader and given the fact that between said preventing means and the flame spreader the above-mentioned combustion mixture distribution chamber is positioned, which is able to regulate, acting as a buffer, the outflow conditions of the mixture from the flame spreader, also in the event of any turbulence generated by the above-mentioned preventing means.

Furthermore the characteristic arrangement of the means for preventing flame propagation, according to the present invention, prevents said preventing means from being dirtied by any remains of food and also prevents the user from accidentally forgetting to refit said means for preventing flame propagation after cleaning the burner.

According to a preferred embodiment of the present invention, furthermore, said preventing means are positioned exactly at the outflow section of the Venturi effect mixer and can comprise, preferably, a helical spring with coil pitch calibrated to between 0.3 and 1.2 mm, when said spring is operating inside the burner.

The particular helical spring conformation of the above-mentioned means for preventing flame propagation facilitates assembly and disassembly of said preventing means, simplifying assembly of the burner and allowing the user to remove and then refit said preventing means for the purposes of maintenance or cleaning inside the burner.

According to a further embodiment of the present invention, the burner is provided with one or more passages for the transit of primary air, drawn by the above-mentioned Venturi effect mixer, from above the supporting surface, on which the burner is fixed, to the inlet section of said mixer. In this case, preferably, the burner furthermore comprises second means for preventing flame propagation, of the fluid flow splitting type, which are arranged upstream of the Venturi effect mixer, between the inlet section of the latter and the corresponding combustion gas injector, and in particular separate said Venturi effect mixer and relative injector from the above-mentioned one or more passages for transit of the primary air.

This also effectively prevents the propagation of flames towards the mixer and injector which can occur, through the primary air passages, during the burner turn-on transient, before complete ignition of the burner terminates the thermodynamic conditions which allow said phenomenon.

BRIEF DESCRIPTION OF THE FIGURES

Some burners according to particular embodiments of the present invention will now be described, solely by way of non-limiting example, with reference to the accompanying figures, in which.

DETAILED DISCLOSURE OF SOME EMBODIMENTS OF THE PRESENT INVENTION

Figure 1:
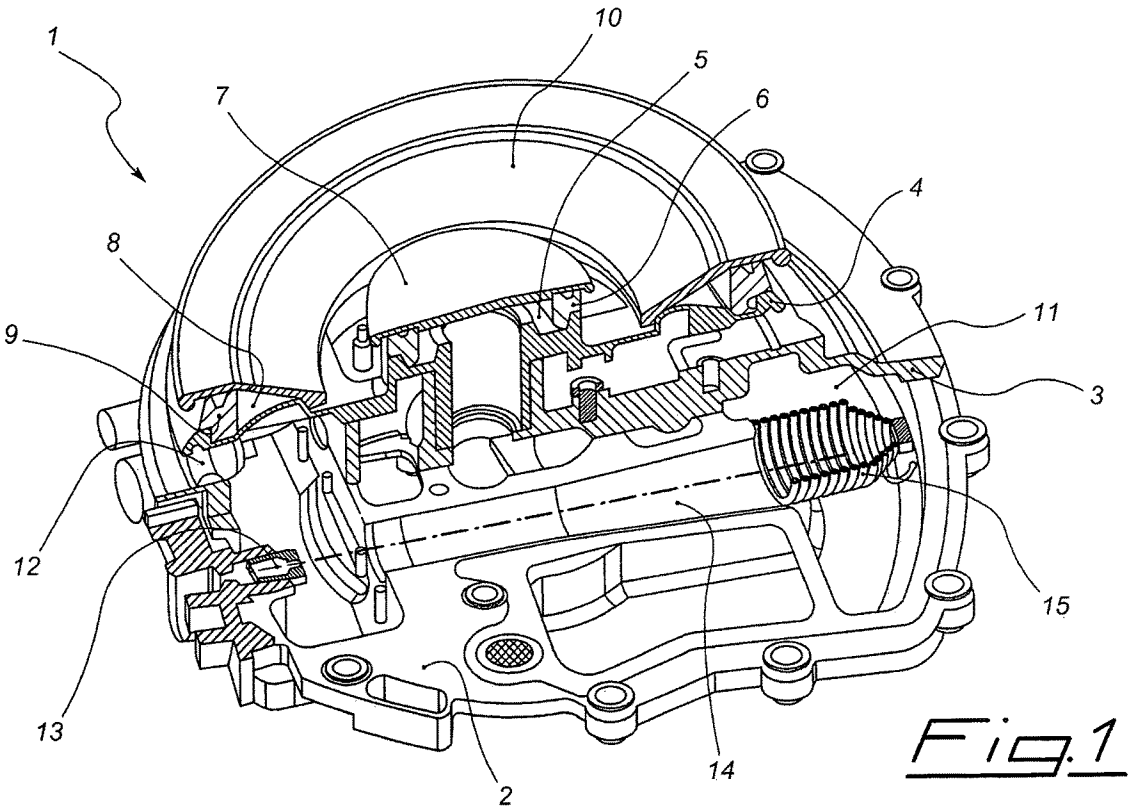
FIG. 1 is a cross-section view of a gas burner according to a particular embodiment of the present invention.
Figure 2:
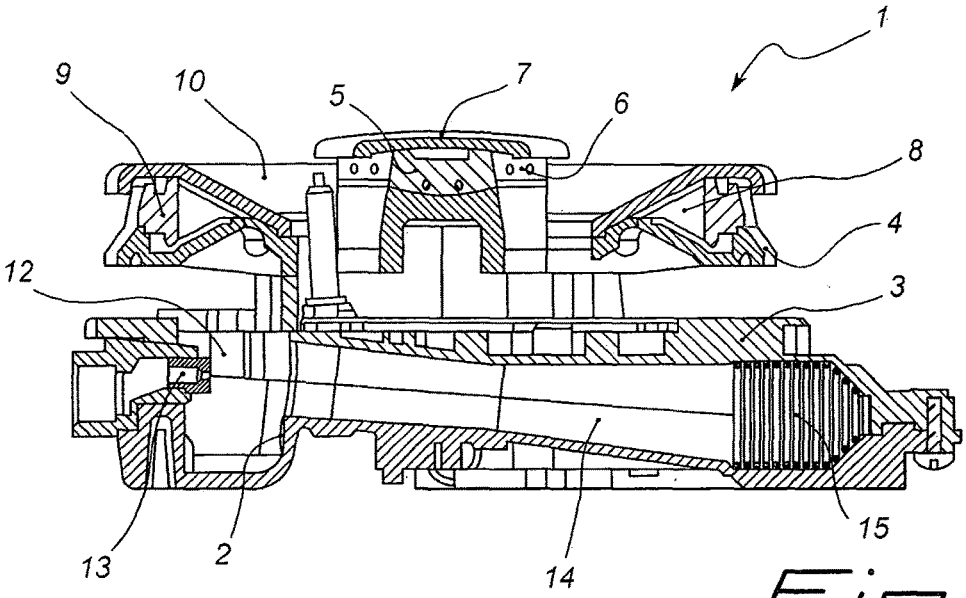
FIG. 2 is a lateral section view of the burner of FIG. 1.
Figure 3:
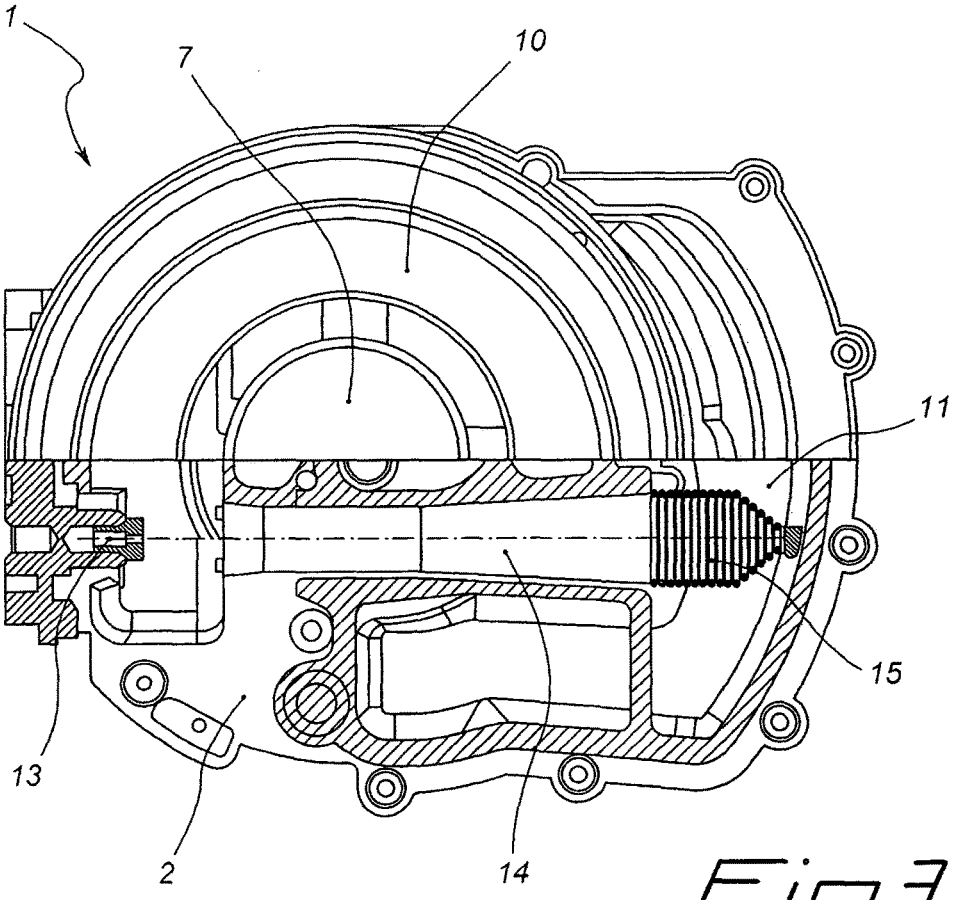
FIG. 3 is an overhead plan view, partially in section, of the burner of FIGS. 1 and 2.

With reference firstly to FIGS. 1-3, the gas burner 1 shown, according to a particular embodiment of the present invention, is of the type suitable for domestic use for cooking food and comprises a cup 2, designed to be secured to a supporting surface for the burner (not shown), and a burner body, mounted on the cup 2, and consisting, in the case in point, of two properly shaped bodies 3, 4, which, assembled one on top of the other, define a central chamber 5 and an external ring-shaped chamber 8 for distribution of the combustion mixture, bearing laterally respective flame spreaders 6 and 9, and relative covers 7 and 10 at the top.

The shaped bodies 3 and 4, with the cup 2, also define at least one Venturi effect mixer 14, ducts 11 for transit of the combustion mixture from the mixer 14 to the distribution chambers 5 and 8, and passages 12 for transit of the primary air from above the aforementioned supporting surface of the burner 1 to the inlet section of the Venturi effect mixer 14.

The burner 1 here illustrated, although only one Venturi effect mixer 14 is shown, can be provided with two Venturi effect mixers for separate and/or combined supply of the distribution chambers 5, 8 and relative flame spreaders 6, 9. However, for the sake of simplicity of description, in what follows only one Venturi effect mixer 14 will be referred to in the burner 1, since it is easy to adapt the following description to a situation in which the burner 1 is provided with two or more Venturi effect mixers.

The Venturi effect mixer of the burner 1 herein shown, according to a preferred embodiment of the present invention, consists of an axial Venturi tube 14, with axis slightly inclined with respect to the horizontal, which is supplied with a flow of combustion gas coming from a relative injector 13.

Advantageously, the burner 1 here illustrated also comprises means 15 for preventing propagation of backfire into the burner 1, of the fluid flow splitting type, arranged downstream of the Venturi tube 14 and upstream of said distribution chambers 5, 8, so as to completely separate said outflow section of the Venturi tube 14 from the above-mentioned chambers 5, 8.

In particular, said backfire propagation preventing means 15 are interposed, in the burner 1 shown here, between the outflow section of the axial Venturi tube 14 and the distribution chambers 5, 8 of the burner 1, and can consist of bodies, made of metal for example, provided with holes or passages sized to permit transit and splitting of the combustion mixture flow.

Figure 6:
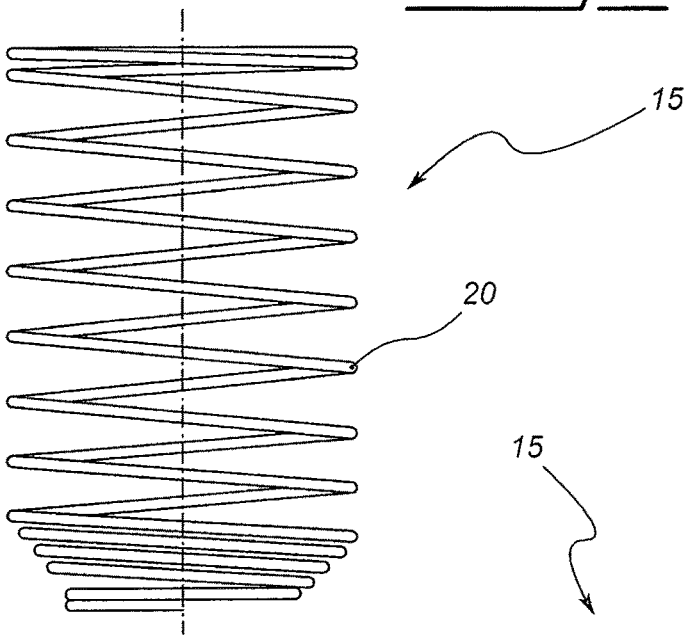
FIG. 6 is a lateral schematic view of a helical spring used as a backfire propagation preventing means in the burners of the preceding figures, in a non-loaded configuration.
Figure 7:
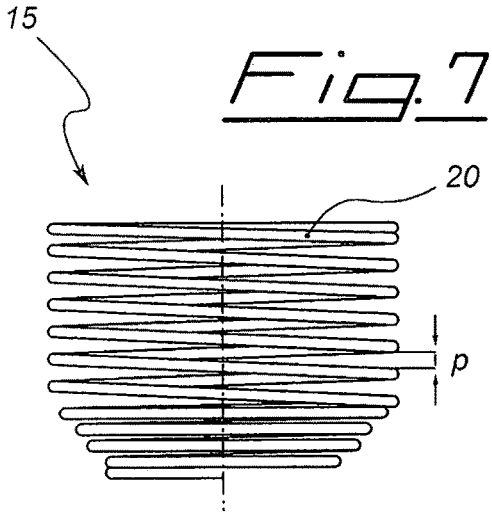
FIG. 7 is a lateral schematic view of the helical spring of FIG. 6, shown in a loaded configuration, in operation.

According to a preferred embodiment of the present invention, with reference also to FIGS. 6 and 7, said backfire propagation preventing means can consist of a helical spring 15, having coil pitch p appropriately calibrated to be preferably between 0.3 and 1.2 mm, when the spring 15 is operating, and more preferably equal to 0.7-0.8 mm, again with the spring 15 in operation.

Said spring 15, which can have a substantially cylindrical shape with directrix not necessarily circular or polygonal, can be made of wire 20, for example stainless spring steel, and can have a constant or variable transverse section (and therefore diameter, in the case of a circular section), for example widened at the end, to engage with the outflow section of the Venturi tube 14, and reduced at the opposite end to favour anchoring to the body 3, 4 of the burner 1.

The spring 15 can clearly consist of any filiform element 20, metal or non-metal, having circular or square section or section of any other shape.

As can be seen in the figures, the above-mentioned spring 15 extends inside the body of the burner 3, 4, starting from the outflow section of the Venturi tube 14 through to an abutment point inside said body 3, 4, in such a way as to separate the outflow section of the Venturi tube 14 from the transit ducts 11, and therefore from the combustion mixture distribution chambers 5, 8, or in such a way that the fluid flow coming out of the Venturi tube 14, or entering the latter in the event of inversion of the fluid flow direction when the burner is turned off, must necessarily cross said spring 15, between the relative coils.

As mentioned, the reduced coil pitch p of the helical spring 15 generates, during passage of the combustion mixture, splitting of the fluid flow into various fluid streams and local variations in the flow speed, which prevent any backfire from passing beyond said helical spring 15 and into the Venturi tube 14 towards the injector 13.

Furthermore, as will be clear to a person skilled in the art, the use of a spring 15 as a backfire propagation preventing means allows simple assembly and disassembly of said spring 15 inside the body 3, 4 of the burner 1, thus easily permitting any maintenance and cleaning operations of said burner 1 and of said spring 15, but without giving rise to possible incorrect assembly of said spring 15 by the user.

It should be observed, as already mentioned, that the distance between the spring 15 and the flame spreaders 6, 9—a distance which is given at least by the relative distribution chambers 5, 8 of the combustion mixture—prevents said spring 15 from being dirtied by any remains of food that have penetrated into the burner 1, with consequent malfunctioning of the burner 1, if the latter is used as a domestic burner for cooking food.

Figure 8:
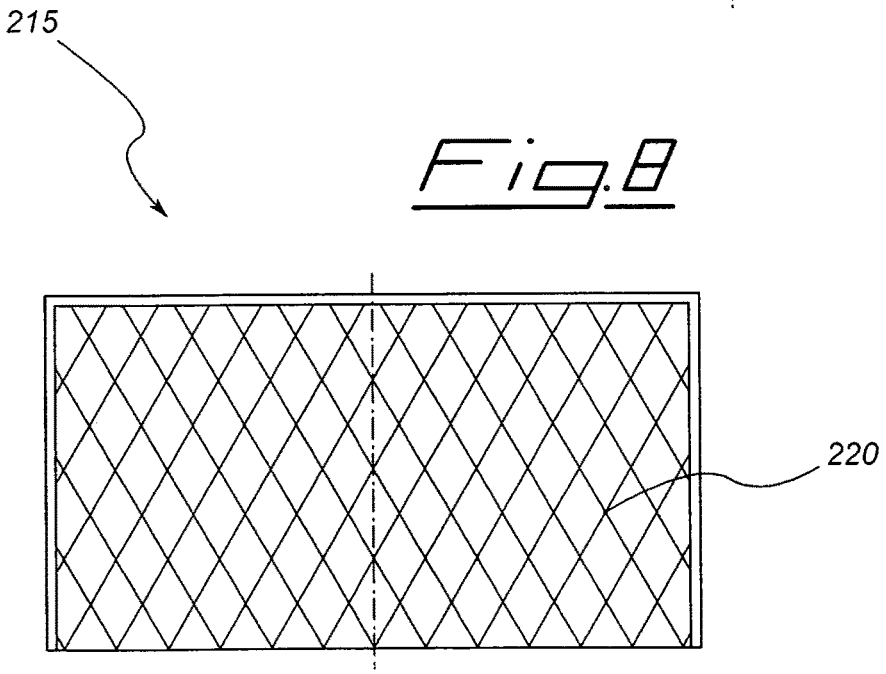
FIG. 8 is a schematic section view of a wire cage which can be used, according to a particular embodiment of the present invention, as a backfire propagation preventing means.

In a further embodiment of the present invention, the helical spring 15 can be replaced, as shown in FIG. 8, by a substantially cylindrical cage 215, the walls of which—wholly or partly—consist preferably of a wire net 220 having mesh of between 0.3 and 1 $mm^2$.

Said cage 215, which preferably has dimensions and conformation such that it can be easily fitted on the outflow end of the Venturi tube 14, performs the same function as the spring 15, separating the fluid flow crossing it into various fluid streams and locally increasing its speed so as to prevent any backfire propagation inside said Venturi tube 14.

Naturally, as will be clear to a person skilled in the art, said cage 215 can also be replaced by a simple wire net, having appropriately calibrated mesh, or by any other body provided with holes or passages sized for the fluid flow, positioned at the level of the outflow section of the Venturi tube 14, so as to completely engage said outflow section.

It should be noticed that, although a gas burner 1 of the type in which the primary air drawn by the Venturi effect mixer 14 is taken from above the supporting surface (or hob) of said burner 1 is shown here, any other type of gas burner in which the primary air is taken wholly or partly from below the supporting surface falls within the scope of protection of the present patent.

Is should also be noticed that, although so far the use of a Venturi effect mixer consisting of an axial Venturi tube 14 has been described, alternatively any other Venturi effect mixer, also radial, can be used, without departing from the scope of protection herein required.

Figure 4:
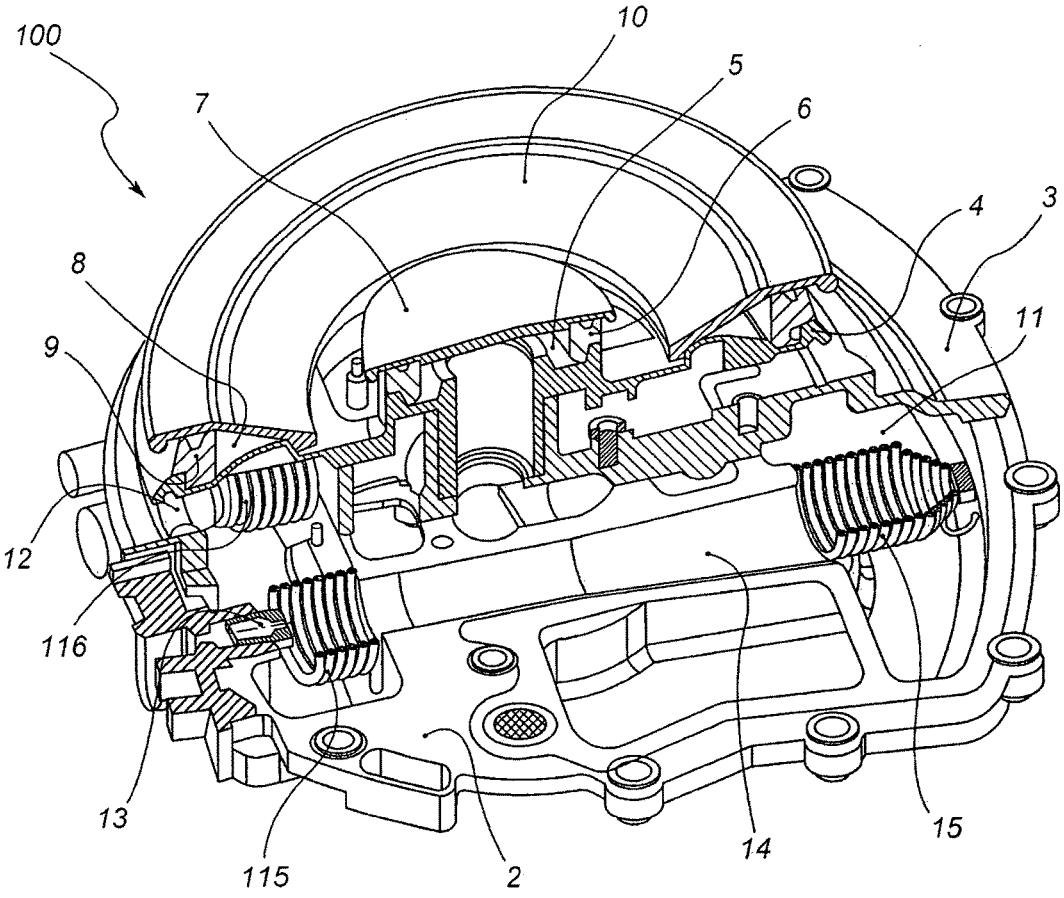
FIG. 4 is a cross-section view of a gas burner, according to another embodiment of the present invention.
Figure 5:
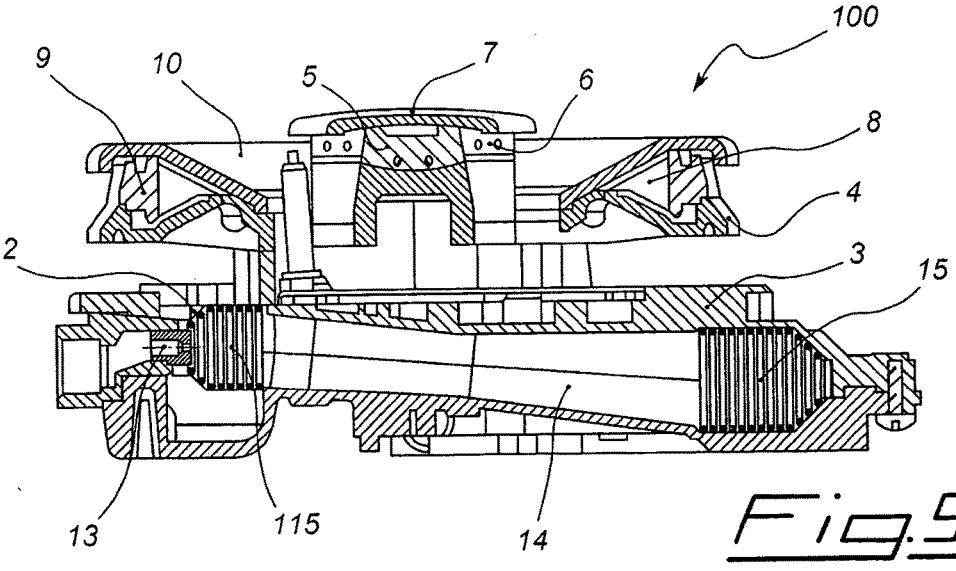
FIG. 5 is a lateral section view of the burner of FIG. 4.

With reference now to FIGS. 4, 5, a gas burner 100 is illustrated, for domestic use, similar to the burner 1 described above, but also provided with second backfire propagation preventing means, interposed between the injector, or injectors, 13 of the combustion gas and the relative Venturi effect mixer 14, or relative Venturi effect mixers.

As will be noted, given the similarity of the two burners 1 and 100, in FIGS. 4 and 5 the components of the burner 100 identical to those of the burner 1 have been indicated by the same reference numbers as those of the burner 1, present in FIGS. 1-3, and will not be further described.

The burner 100, which like the burner 1 is provided with two Venturi effect mixers consisting, preferably, of two axial Venturi tubes 14, with axis parallel and slightly inclined downwards, comprises not only the backfire propagation preventing means 15, interposed between the outlet section of the Venturi tubes 14 and the combustion mixture distribution chambers 5, 8, described above with reference to the burner 1, but also second means for preventing flame propagation 115, 116, of the fluid flow splitting type, arranged immediately upstream of the Venturi tubes 14, and in particular interposed between the injectors 13 and relative inlet sections of the Venturi tubes 14.

Said second preventing means 115, 116, which can consist, analogously to the preventing means 15, of helical springs (see FIGS. 6 and 7) composed of wire 20, for example stainless steel, with coil pitch p calibrated and between 0.3 and 1.2 mm, are appropriately shaped to separate the relative injector 13 and the relative inlet section of the Venturi tube 14 from the passages 12 for transit of the primary air from above the supporting surface of the burner 100.

In particular, in the case of use of the helical springs 115, 116, each of said springs 115, 116 is secured to the inlet section of the relative Venturi tube 14 and to the corresponding injector 13, so as to define a cylindrical space, laterally delimited by said spring 115 or 116, inside which the flow of gas coming out of the injector 14 and flowing towards the Venturi tube 14 can pass.

The calibrated space between the coils of each spring 115, 116 permits the inflow of primary air, drawn by the Venturi tubes 14, coming from the passages 12 and flowing towards the relative inlet sections of said Venturi tubes 14, but prevents, due to splitting of the fluid flow and local acceleration of said fluid flow passing inside each spring 115, 116, any propagation of free flames coming from the above-mentioned primary air transit passages 12.

The alternative use of bodies, preferably cylindrical or tubular, with perforated lateral walls (for example wire nets with appropriately sized mesh), or consisting of filiform elements wound in a spiral, between each injector 13 and the relative inlet section of the Venturi effect mixer 14 is just one of the possible solutions protected by the present patent, as will be easily understood by a person skilled in the art.

The operation of the burner 100, and therefore the burner 1, during the turn-on transient and turn-off transient, is the following.

During turn-on of the burner 100, given the adjacency of the inlets 12 for transit of the primary air to the external flame spreader 9, and given the possible presence of combustion mixture emitted from the flame spreader 9 and not yet ignited, inside said passages 12—which draw a fluid flow to the inside of the burner 100—backfiring may occur at ignition inside said transit passages 12, towards the injectors 13 and the relative Venturi tubes 14.

The presence of the helical springs 115, 116, with appropriately calibrated coil pitch, interposed between injectors 13 and inlet sections of the relative Venturi tubes 14, constituting the above-mentioned second backfire propagation preventing means, of the fluid flow splitting type, prevent any flames present inside the passages 12, as said, from passing beyond the lateral walls of said springs 115, 116 and therefore from damaging the injectors 13 and the relative Venturi tubes 14.

During the turn-off transient, on the other hand, lack of the combustion mixture flow from the flame spreaders 6 and 9 and the substantially static presence of a certain quantity of combustion mixture upstream of the Venturi tubes 14, inside the ducts 11 and the distribution chambers 5 and 8, can favour backfiring into the burner 100, via said distribution chambers 5 and 8 and the ducts 11.

Furthermore, in the not uncommon event of immediate re-ignition of the burner 100, up to 3-4 seconds from the relative turn-off, the presence of gas—unburned primary air mixture inside the distribution chambers 5 and 8 and in the ducts 11 can easily cause backfiring at ignition from the flame spreaders 6 and 9, spreading via the distribution chambers 5, 8 and the ducts 11 towards the Venturi tubes 14 and the injectors 13 of said burner 100.

However, the presence of the helical springs 15, interposed between said ducts 11 and the outflow section of the Venturi tubes 14 so as to separate said ducts 11, and the chambers 5 and 8 positioned downstream, from said outflow sections of the Venturi tubes 14, constituting the above-mentioned first means for preventing flame propagation of the fluid flow splitting type, prevents the flames, as mentioned above, from penetrating inside said springs 15, and therefore from damaging said Venturi tubes 14 and relative injectors 13.

The invention claimed is:

1. A gas burner for domestic use, comprising at least one Venturi effect mixer, the Venturi effect mixer having a longitudinal axis and being in fluid connection with at least one combustion mixture distribution chamber through a transit duct and at least one flame spreader associated with said at least one combustion mixture distribution chamber, as well as first means for preventing flame propagation of the fluid flow splitting type, wherein said first preventing means completely separates said at least one Venturi effect mixer from said at least one combustion mixture distribution chamber, said first preventing means is arranged downstream of and external to said at least one Venturi effect mixer, upstream of said transit duct, and upstream of and external to said at least one combustion mixture distribution chamber, said first preventing means being arranged at an outflow section of said at least one Venturi effect mixer and extending along the longitudinal axis of the Venturi effect mixer to an abutment point defined by an intersection of said longitudinal axis with an internal surface of the burner.

2. The burner as claimed in claim 1, wherein said first preventing means comprises a body provided with holes or passages calibrated for the passage of a fluid.

3. The burner as claimed in claim 2, wherein said first preventing means comprises a body provided with one or more walls consisting of a wire net.

4. The burner as claimed in claim 3, wherein said wire net has meshes of between 0.3 and 1 $mm^2$.

5. The burner as claimed in claim 2, wherein said first preventing means comprises a substantially tubular body produced by means of at least one filiform element wound in a helical spiral.

6. The burner as claimed in claim 5, wherein said body is a helical spring.

7. The burner as claimed in claim 5, wherein the coil pitch of said body is between 0.3 and 1.2 mm.

8. The burner as claimed in claim 5, wherein said substantially tubular body has a circular section with constant or variable diameter along its longitudinal axis.

9. The burner as claimed in claim 1, further comprising second means for preventing flame propagation of the fluid flow splitting type, said second preventing means being arranged upstream of said at least one Venturi effect mixer, between the inlet section of said at least one mixer and the corresponding combustion gas injector.

10. The burner as claimed in claim 9, comprising one or more passages for the transit of primary air from above the supporting surface, to which the burner is fixed, to said inlet section of said at least one Venturi effect mixer, wherein said second preventing means separates said at least one Venturi effect mixer and said combustion gas injector from said one or more passages for transit of the primary air.

11. The burner as claimed in claim 9, wherein said second preventing means comprises at least one substantially tubular body with relative lateral walls extending at least between said combustion gas injector and said inlet section of said at least one Venturi effect mixer, said at least one substantially tubular body comprising at least one filiform element wound in a spiral.

12. The burner as claimed in claim 11, wherein said at least one substantially tubular body is a helical spring.

13. The burner as claimed in claim 1, wherein said at least one Venturi effect mixer is an axial Venturi tube.

14. The burner as claimed in claim 2, wherein said body of the first preventing means extends inside the burner starting from the outflow section of said at least one Venturi effect mixer through to the abutment point inside said burner, in such a way as to separate the outflow section of said at least one Venturi effect mixer from the transit duct.

15. The burner as claimed in claim 14, wherein said body of the first preventing means extends inside the burner starting from the outflow section of said at least one Venturi effect mixer through to the abutment point inside said burner, in such a way as to separate the outflow section of said at least one Venturi effect mixer from the distribution chamber.

16. The burner as claimed in claim 1, wherein the distribution chamber bears lateral flame spreaders.

* * * * *